US005472145A

United States Patent [19]

Shannon et al.

[11] Patent Number: 5,472,145

[45] Date of Patent: Dec. 5, 1995

[54] STRAIGHT STREAM NOZZLE

[75] Inventors: Timothy C. Shannon, Lexington; Steven L. Honeycutt, Milan, both of Tenn.

[73] Assignee: Delavan Inc., West Des Moines, Iowa

[21] Appl. No.: 227,834

[22] Filed: Apr. 14, 1994

[51] Int. Cl.[6] ..... B05B 1/14

[52] U.S. Cl. ..... 239/552; 239/553.3; 239/558; 239/590.3

[58] Field of Search ..... 239/548, 552, 239/553, 553.3, 553.5, 556, 558, 590, 590.3, 590.5, 596

[56] References Cited

U.S. PATENT DOCUMENTS

| | | | |
|---|---|---|---|
| 2,096,912 | 10/1937 | Morris | 239/558 X |
| 2,351,819 | 6/1944 | Judell | 239/590.5 X |
| 2,408,588 | 10/1946 | Watts | 239/553.5 X |
| 4,537,360 | 8/1985 | Bock | 239/558 X |
| 4,565,324 | 1/1986 | Rebula et al. | 239/550 X |
| 5,141,163 | 8/1992 | Scheidler | 239/558 |
| 5,186,620 | 2/1993 | Hollingshead | 239/558 X |

FOREIGN PATENT DOCUMENTS

| | | | |
|---|---|---|---|
| 914174 | 12/1962 | United Kingdom | 239/558 |

*Primary Examiner*—Andres Kashnikow
*Assistant Examiner*—Lesley D. Morris
*Attorney, Agent, or Firm*—Howard S. Reiter; Richard W. Watson

[57] ABSTRACT

A straight stream nozzle for use in directing a liquid stream at a solid surface with greater force at greater distances. The nozzle has concentric arrays of ports around a solid center. As liquid is forced through the ports, that liquid passing through the outer array of ports shields that passing through the inner array and the solid nozzle center creates a hollow center in the liquid stream which tends to promote cohesion of the inner array of streams into a single more highly concentrated stream which produces high impact at a substantial distance.

15 Claims, 1 Drawing Sheet

STRAIGHT STREAM NOZZLE

FIELD OF THE INVENTION

This invention relates generally to nozzles for producing a straight liquid stream and more particularly to such nozzles which produce a stream which is more cohesive at greater distances from the nozzle face.

BACKGROUND OF THE INVENTION

In various instances it is desirable to utilize a liquid stream to impact upon a solid surface and thus help to remove rust, scale or other solid matter from such surface. The use of such a liquid stream may be particularly desirable in situations where it is difficult to reach the surface to be cleaned, as for instance in large tanks, furnaces and the like. With previously available nozzles a continuing or recurring problem has been a tendency of the fluid stream to fan out or spread apart as the liquid gets further from the point of discharge from the nozzle. The result of such spreading apart of the liquid stream is a reduction in the force applied when the stream impacts on the surface to be cleaned. As a result, it may be necessary to use a larger nozzle or a greater amount of time to achieve satisfactory results.

One application in which such straight stream nozzles are useful is in the cleaning of soot blowers where an elongated member commonly called a lance is provided with a plurality of nozzles and inserted into the blower through one or more openings provided for that purpose. Construction and operation of such apparatus is described in U.S. Pat. Nos. 4,209,028, 4,422,882 and others and need not be described here in further detail.

Various attempts have been made previously to provide improved nozzle designs whereby a liquid stream maintains greater integrity even at substantial distances from the point of discharge from the nozzle. One such prior design is described in U.S. Pat. No. 4,565,324 wherein a plurality of smaller streams are discharged in such a manner as to generally surround a single large central stream. Nozzles in accord with this patent produce a more concentrated and coherent fluid stream than earlier designs but still evidence some stream deterioration, especially at substantial distances from the point of discharge.

SUMMARY OF THE INVENTION

Improved performance has now been achieved by the present invention in which a nozzle is provided with concentric arrays of axially extending through ports surrounding a solid center. As liquid flows through all of the ports, the substantial number of passageways helps to produce a more laminar, less turbulent and more cohesive flow and the liquid discharged from the radially outer ports helps to shield the streams which emerge from the inner ports. As a result of the improved cohesiveness, a stream of any given volume and pressure will be more concentrated at impact upon a surface and thus impart greater force on that surface.

It is thus a primary object of the present invention to provide a nozzle which discharges a more cohesive liquid stream and more especially a stream which holds together better at a substantial distance from the point of discharge from such a nozzle.

Another object of the invention is to provide a nozzle which produces a fluid stream with less turbulence.

A further object of the invention is to provide a nozzle which accomplishes a greater amount of work in the same time as prior known nozzles.

Yet another object of the invention is to provide such a nozzle which is relatively simple in construction and which can be retrofitted into existing machinery or equipment.

BRIEF DESCRIPTION OF THE DRAWINGS

These and other objects, features and advantages of this invention will be made more fully understandable to those having skill in this art by reference to the following specification and claims, and to the accompanying drawings, in which:

DETAILED DESCRIPTION OF THE INVENTION

Figure 1:
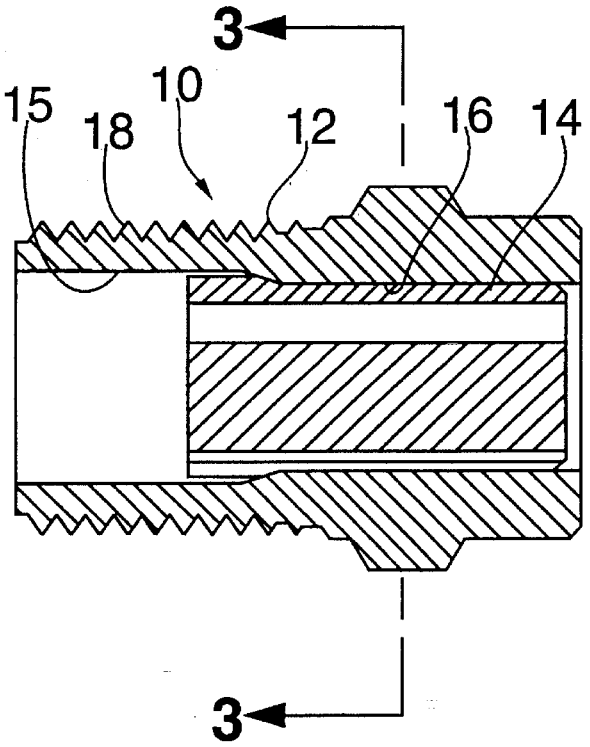
FIG. 1 is a sectional view of a preferred nozzle along an axial plane.
Figure 2:
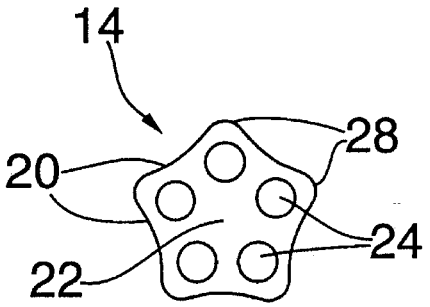
FIG. 2 is a view of a nozzle core along a transverse plane.

Referring now to the drawings, FIG. 1 shows in side sectional view a preferred nozzle made in accord with the invention. Thus, a nozzle 10 comprises an outer body 12 and an inner core 14. Outer body 12 preferably has a stepped bore 15–16 dimensioned to receive a stepped outer diameter of inner core 14. Preferably, body 12 also has a threaded portion 18 to allow easy connection of the nozzle to supporting equipment. As best seen in FIG. 2 inner core 14 is provided with a plurality Y of surfaces 20 on its outer periphery, each such surface being equal to one another and equally spaced from one another so as to form a regular or symmetrical pattern. Surfaces 20 may be concave, convex, straight or of other shape, as long as all are of the same form. Inner core 14 also has a solid center portion 22 around which is arrayed a plurality X of holes or ports 24 which together form a first plurality of axially extending through ports which are equally spaced and of equal diameter and thus form a regular or symmetrical pattern. The solid center portion 22 creates a hollow center in the liquid stream at the point of discharge from the nozzle and this hollow center apparently forms an area of low pressure which in turn promotes cohesion of the inner array of streams to form a more concentrated liquid stream which produces a greater impact on the target surface.

Figure 3:
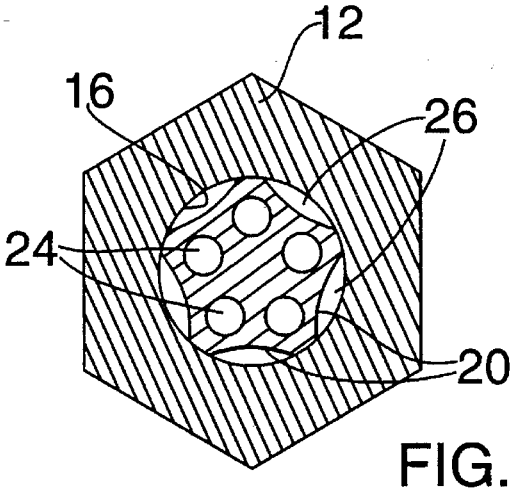
FIG. 3 is a sectional view of the nozzle assembly of FIG. 1 along line 3—3 of FIG. 1.

In FIG. 3, it is clearly seen that when inner core 14 is assembled with outer body 12, surfaces 20 of the inner core combine with equal portions of bore 15–16 to form therebetween a series of elongated passages or ports 26 which together form a second plurality of axially extending through ports. This second plurality of ports is arrayed radially outwardly of the first plurality of ports 24 and thus generally surrounds the first plurality or array. In the preferred nozzle as shown, the core 14 is retained in the nozzle body 12 by means of a press fit between ribs 28 and the lesser diameter portion 16 of stepped inner bore 15–16 of outer body 12. The number of ports in each array is limited only by the overall size of the finished nozzle. In a typical soot blower lance for instance, the outer diameter of the nozzle body will be on the order of ⅝ inch and thus the use of more than five or six ports in each array would be impractical.

Within the preceding parameters a number of design features are thought to be preferred. For example, it is believed that the most preferred arrangement is one in which the number of ports in each array is equal and further is one in which the total cross-sectional area of the ports in each array is substantially equal. It is also to be preferred that the array of ports formed between the nozzle core and the nozzle body (the radially outer array of ports) be of generally slotlike or elongated form in transverse section and with the major axis of each such port substantially perpendicular to a radius of the nozzle passing through the midpoint of the major axis. It is also to be preferred that the axially extending through ports in each array each be of a length at least equal to the mean diameter of such ports and more preferably several times that diameter in order to reduce turbulence and to enhance laminar flow of the liquid. Another preferred design feature would be for the outer (discharge) end of stepped bore 15–16 of the nozzle outer body 12 to have a very slight (e.g. 3 or 4 degree) inward taper to direct the liquid flow very slightly inwardly.

Comparative performance results between the nozzle of the invention and the tested nozzle of U.S. Pat. No. 4,565,324 show that a significant improvement is obtained with the new design. For example, with a pressure of 300 psig and a flow rate of 15 gallons (U.S.) per minute and at a distance of 15 feet, the prior nozzle exhibits a spray pattern somewhat more than twice the diameter of the nozzle of the invention.

While a preferred embodiment and some variations thereof have been shown and described in detail, other modifications will be readily apparent to those skilled in the art of nozzles. For example, while a two piece nozzle is presently preferred for ease of manufacture, a one piece nozzle may be equally satisfactory in some instances. Further, while a press fit of the inner core into the nozzle body is preferred, other means such as a snap ring or a threaded retainer may be used to hold the core and body in proper relative position. It is also quite likely that the nozzle of the invention will be used in combination with other types of nozzles such as spray nozzles to form a composite multi purpose nozzle assembly. Thus, the preceding specification should be interpreted as exemplary rather than as limiting and the scope of the invention is defined by the following claims.

We claim:

1. A nozzle for producing a straight liquid stream, said nozzle having a first plurality of axially extending through ports arrayed in a regular pattern around a solid center portion and a second plurality of transversely elongated axially extending through ports arrayed in a regular pattern radially outwardly of said first plurality of ports, each of said transversely elongated ports having a major axis and being oriented such that said major axis of each of said transversely elongated ports is substantially perpendicular to a nozzle radius such that said major axis has a greater dimension than a dimension of said transversely elongated port along the nozzle radius.

2. The nozzle of claim 1 in which the number of ports in said first plurality is equal to the number of ports in said second plurality.

3. The nozzle of claim 1 in which the total area of said first plurality of ports is substantially equal to the total area of said second plurality of ports.

4. The nozzle of claim 1 in which said first plurality of axially extending through ports are located in a unitary core member.

5. The nozzle of claim 1 in which the axial length of each of said ports is several times the mean diameter of said port.

6. A nozzle for producing a straight liquid stream, said nozzle having a first array of X axially extending through ports arranged in a regular pattern around a solid center portion, said nozzle also having a second array of Y transversely elongated axially extending through ports arranged in a regular pattern and generally surrounding said first array of ports, each of said transversely elongated ports having a major axis and being oriented such that said major axis of each of said transversely elongated ports is substantially perpendicular to a nozzle radius such that said major axis has a greater dimension than the dimension of said transversely elongated port along the nozzle radius.

7. The nozzle of claim 6 in which X equals Y.

8. The nozzle of claim 6 in which the total area of said first array of ports is substantially equal to the total area of said second array of ports.

9. The nozzle of claim 6 in which said first array of axially extending through ports is located in a unitary core member.

10. The nozzle of claim 6 in which the axial length of each of said ports is several times the mean diameter of said port.

11. The nozzle of claim 6 in which said inner core is a unitary member.

12. The nozzle of claim 6 in which the axial length of each of said ports is several times the mean diameter of said port.

13. A nozzle for producing a straight liquid stream, said nozzle comprising an annular outer body and an inner core, said inner core having a first array of substantially annular axially extending through ports surrounding a solid center portion and said core and said body forming therebetween a second array of transversely elongated axially extending through ports, each of said arrays formed in a regular pattern and said second array generally surrounding said first array of ports, each of said transversely elongated ports having a major axis and being oriented such that said major axis of each of said transversely elongated port is substantially perpendicular to a nozzle radius such that said major axis has a greater dimension than the dimension of said transversely elongated port along the nozzle radius.

14. The nozzle of claim 9 in which the number of ports in said first array is equal to the number of ports in said second array.

15. The nozzle of claim 13 in which the total area of said first array of ports is substantially equal to the total area of said second array of ports.

* * * * *